US005241792A

United States Patent [19]

Naka et al.

[11] Patent Number: 5,241,792

[45] Date of Patent: Sep. 7, 1993

[54] METHOD AND APPARATUS FOR SURFACE FINISHING

[75] Inventors: Hirokazu Naka; Tadashi Hayasaka, both of Iwata, Japan

[73] Assignee: Yamaha Hatsudoki Kabushiki Kaisha, Shizuoka, Japan

[21] Appl. No.: 831,979

[22] Filed: Feb. 6, 1992

[30] Foreign Application Priority Data

Feb. 8, 1991 [JP] Japan ..... 3-60751
Jun. 14, 1991 [JP] Japan ..... 3-169063

[51] Int. Cl.[5] ..... B24B 21/00; B24B 49/08; B24B 49/16

[52] U.S. Cl. ..... 51/165.9; 51/141; 51/145 R

[58] Field of Search ..... 51/165.9, 135 R, 141, 51/334, 335, 143, 144, 145

[56] References Cited

U.S. PATENT DOCUMENTS

| | | | |
|---|---|---|---|
| 1,964,295 | 6/1934 | Miller et al. | 51/336 |
| 2,549,043 | 4/1951 | Arthur | 51/334 |
| 2,648,176 | 8/1953 | Zimmerman | 51/135 |
| 2,876,600 | 3/1959 | Pendergast | 51/141 |
| 3,394,501 | 7/1968 | Carlson et al. | 51/165.9 |
| 3,415,017 | 12/1968 | Murray | 51/135 R |
| 3,798,843 | 3/1974 | Weatherell | 51/165.9 |
| 3,834,200 | 9/1974 | Winter | 51/334 |
| 4,137,673 | 2/1979 | La Tour | 51/141 |
| 4,967,513 | 11/1990 | Hundebol | 51/141 |
| 5,119,601 | 6/1992 | Yamashita et al. | 51/334 |

FOREIGN PATENT DOCUMENTS

| | | | |
|---|---|---|---|
| 539946 | 4/1957 | Canada | 51/141 |
| 0146653 | 6/1989 | Japan | 51/135 R |
| 0185361 | 7/1990 | Japan | 51/135 R |

*Primary Examiner*—William E. Terrell
*Assistant Examiner*—Bryan Reichenbach
*Attorney, Agent, or Firm*—Bacon & Thomas

[57] ABSTRACT

A method and apparatus for finishing the surface of a work article is disclosed wherein the article is transferred to a polishing head of a polishing machine by a multi-joint industrial robot. The polishing head may extend or retract in the direction of movement of the work article toward the polishing machine such that the force exerted on the work article by the polishing head may be kept generally constant throughout the polishing operation.

9 Claims, 3 Drawing Sheets

METHOD AND APPARATUS FOR SURFACE FINISHING

BACKGROUND OF THE INVENTION

I. Field of the Invention

The present invention pertains to a method and apparatus for surface finishing a manufactured article and, more particularly, a system for providing a substantially constant polishing force during the finishing process.

II. Description of the Prior Art

After an article is manufactured, it is often necessary to finish the outer surface of the article. For instance, if the article is die casted, burrs are often formed on the article's outer surface. In addition, it is not uncommon for fine cracks to develop in a casting die due to thermal fatigue which can result in surface undulations in the casted product which must be removed. Surface finishing is often required for both metal products and plastic moldings.

Although such finishing operations are generally manually performed, it is desirable to automate the process. In this connection, an industrial robot may be utilized which includes an arm for grasping the work article and bringing it into contact with the polishing tool. (As used herein, "polishing" is a generic term for surface finishing and can include such finishing operations as grinding and sanding.) The industrial robot can be programmed to transfer the work product to specified locations so as to come into contact with a polishing tool and to reposition the work product so that multiple surfaces thereof can be finished. In practice, it has been found that the contact pressure between the finishing tool and successive work products vary due to wearing of the polishing tool.

To compensate for varying contact pressures, it is possible to alter the program of the industrial robot such that the work product is repositioned on the basis of detected wear of the polishing tool. Unfortunately, such arrangements require complicated and expensive system changes. For instance, not only is a sensor for detecting the wear of the polishing tool required, a special function must also be added to the robot to vary its range of movement.

In addition, if the polishing tool wears unevenly, it becomes necessary to reshape the polishing tool which results in down time of the finishing system. Further, if the work product is excessively forced against the polishing tool, the robot motor could be damaged. Therefore, in such a system, the robot must be provided with a protection system which further complicates the operation of the robot and adds to its expense.

Therefore, there exists a need in the art for a method and apparatus for finishing a work product which can compensate for polishing tool wear which will not require additional programming or an overload protection system to be added to the robot controls. In general, there exists a need to provide a simple assembly for compensating for wear on a polishing tool so that a consistent surface finish can be provided on successive manufactured products.

SUMMARY OF THE INVENTION

The present invention pertains to a method and apparatus for finishing the surface of a work product which is transferred to a polishing machine by a multi-joint industrial robot. The polishing machine includes a polishing head which can be extended or retracted toward the surface of the work product to be polished. In one embodiment of the present invention, an actuator mechanism is provided to control the force exerted by the polishing head on the work product so that a generally constant pressure is maintained. In another embodiment, the polishing head itself is designed to control the exerted pressure. Both of these arrangements provide a rather simple but effective system for uniformly finishing successive work products.

Additional features and advantages of the present invention shall become more apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
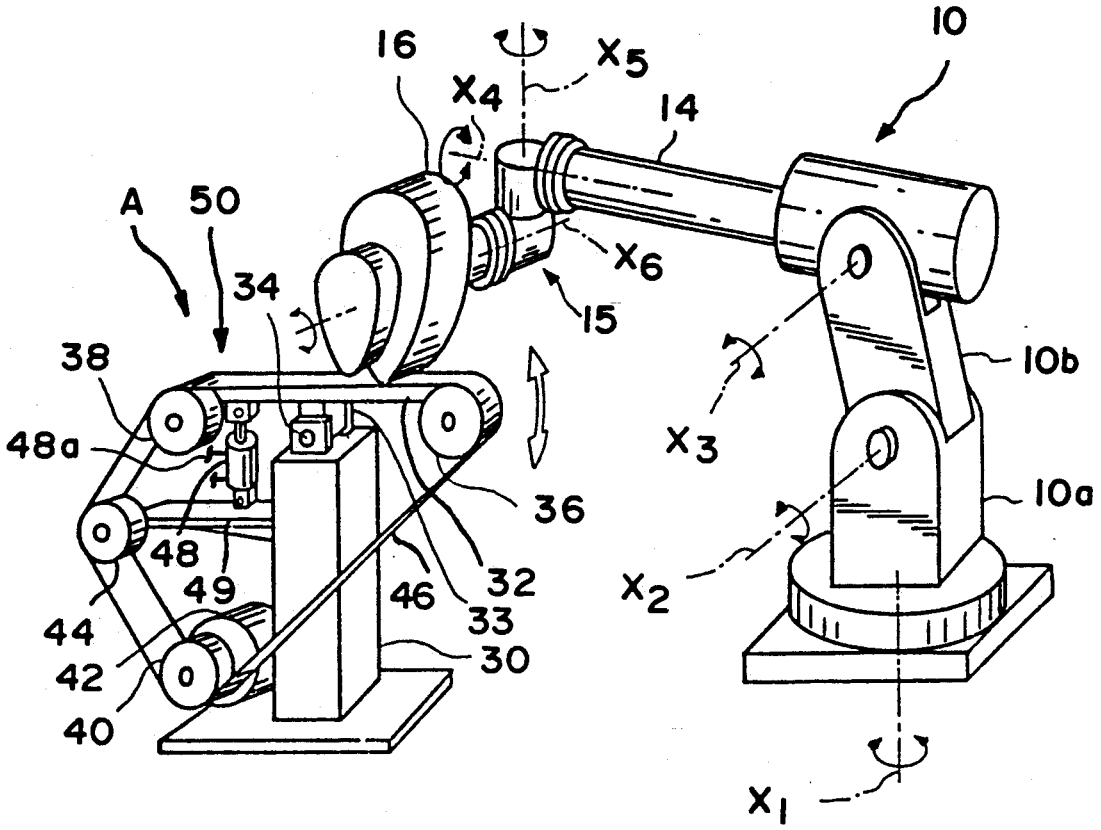
FIG. 1 is a perspective view showing a first embodiment of the invention.
Figure 3:
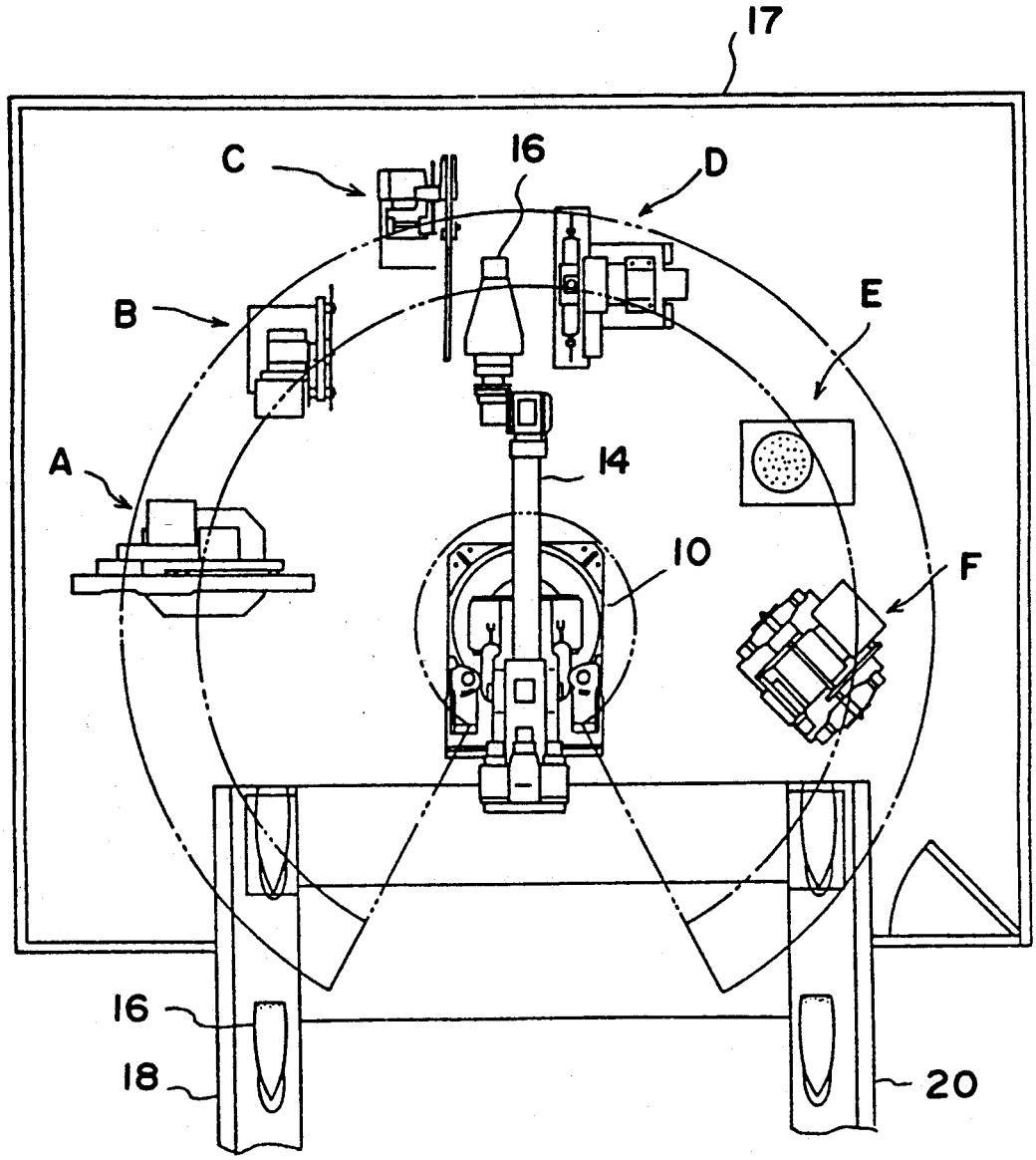
FIG. 3 is a plane view showing a multi-station finishing system to which the present invention is applicable.

In FIGS. 1 and 3 reference numeral 10 denotes a multi-joint industrial robot having a base 10A which rotates about a vertical axis $X_1$. Rotating base 10A is attached to a plate (not labeled) which is adapted to be fixedly secured to a support base such as a floor. Pivotally attached to rotating base 10A is a swing arm 10B which is permitted to swing back and forth about a horizontal axis $X_2$ located at the upper end of rotating base 10A. An arm 14 is connected, adjacent one end thereof, to the upper end of swing arm 10B so as to be rotatable about a horizontal axis $X_3$. The other end of arm 14 has attached thereto a wrist joint generally indicated at 15. Wrist joint 15 is permitted to rotate about three generally perpendicular axes $X_4$, $X_5$ and $X_6$. Axis $X_4$ is generally defined by the longitudinal axis of arm 14, axis $X_5$ is a vertical axis located substantially orthogonal to axis $X_4$ and axis $X_6$ extends generally horizontal, substantially perpendicular to both axes $X_4$ and $X_5$.

As is known in the art, the end of wrist joint 15 remote from its attachment to arm 14 is provided with a gripping device (not shown) for grasping a work product 16 which is transported into a work room 17 by means of a conveyor 18 (see FIG. 3). Portions of work article 16 are intended to be finished at each of stations A–F and are then placed on a second conveyor 20 for removal from work room 17. As clearly shown in FIG. 3, polishing machines A–F are arranged in a predefined order within work room 12. Robot 10 is pre-programmed to transport each work article 16 to the various polishing machines A–F while rotating and reciprocating the work article 16 into predetermined positions such that each polishing machine finishes a specific portion of each work article 16.

Polishing tools A–F as shown in FIG. 3 represent a belt sander A, an R-sander B, a long sander C, a drill machine D, a disk sander E and a wheel sander F respectively. Each of these polishing tools A–F, with the exception of drill machine D, are intended to be mounted in a manner according to the present invention to exert a substantially constant pushing force on work article 16 during the polishing processes as will be discussed more fully below with particular reference to FIG. 1 which depicts belt sander A in accordance with the present invention.

In FIG. 1, reference numeral 30 denotes a support stand on the upper end of which is pivotally mounted a swing lever 32. More particularly, intermediate its ends, swing lever 32 includes a downwardly projecting flange 33 which is pivotally attached to the upper end of support stand 30 through a fulcrum pin 34 that provides a fulcrum axis for lever 32. Guide rollers 36 and 38 are respectively rotatably mounted on the ends of swing arm 32. Reference numeral 40 denotes a driving roller which is secured to the output shaft of an electric motor 42 attached to or otherwise fixedly secured along with support stand 30 in a stationary position. A tension roller 44 is also provided which is biased away from support stand 30 by any means known in the art (not shown). An endless polishing belt 46 is entrained around rollers 36, 38, 40 and 44 and is set to a predetermined tension by adjusting the biasing force upon tension roller 44. Although not particularly shown in FIG. 1, a low friction plate may be fixedly secured upon the upper surface of swing lever 32 so as to be in sliding contact with the bottom surface of belt 46 between rollers 36 and 38. In the alternative, a low friction coating may be applied to the upper surface of swing lever 32. The upper surface of belt 46 thus presents a sanding zone lying in a generally horizontal (as illustrated) sanding plane for receiving a work article.

A fluid actuator 48, preferably a pneumatic actuator, is pivotally connected at its upper end to a bottom surface portion of swing lever 32 and at its lower end to a support arm projecting from support stand 30. The construction of fluid actuator 48 is known in the art and is therefore not shown. In general, the actuator includes a cylinder which is divided into upper and lower chambers by a piston which is fixedly secured to an actuating rod. In the present embodiment, the rod is pivotally secured to the lower side surface of swing lever 32 and the cylinder is pivotally secured to support arm 49. Fluid actuator 48 is supplied with working fluid at a constant pressure by means of a pump (not shown). In the preferred embodiment, a pneumatic cylinder is utilized which is supplied with air via lines 48*a* from an air pump at a constant pressure which maintains a constant retraction force upon the actuator rod tending to pivot the left end of swing lever 32 about fulcrum pin 34 towards support arm 49, and the right end toward the position of the work article 16 in its polishing position.

In operation, work article 16 is transported by robot 10 to a predetermined position in contact with belt 46 to one side of fulcrum pin 34. In the preferred embodiment, robot 10 positions work article 16 above swing arm 32 on a side opposite the connection of fluid actuator 48. When work article 16 comes into contact with swing arm 32, swing arm 32 is caused to swing downward about fulcrum pin 34. Since the contracting force of fluid actuator 48 is maintained constant, the contacting force between belt 46 and the work article 16 is also maintained constant. Robot 10 may then rotate or reciprocate work article 16 while maintaining contact with belt 46 to polish the desired surface of work article 16. Throughout the operation, a substantially constant upward force tending to maintain work article 16 in contact with one end portion of swing lever 32 is provided by the downward force exerted upon the other side of swing lever 32 by fluid actuator 48.

It should be noted that the downward force exerted on swing lever 32 on one side of fulcrum pin 34 by fluid actuator 48 is set lower than the vertical rigidity of arm 14 of robot 10. In other words, the force exerted upon arm 14 of robot 10 through work article 16 and wrist joint 15 by fluid actuator 48 is lower than the maximum vertical force which arm 14 can counteract without being forcibly pivoted about axis $X_3$. By minimizing the force developed by fluid actuator 48 in this manner, the servo motor of robot 10 can be protected without employing any special overload circuitry. Furthermore, since belt 46 extends in a substantially horizontal plane defined by swing lever 32 and the work article 16 is brought into engagement with belt 46 in a plane generally perpendicular to this horizontal surface, the vertical vibration caused when robot 10 transfers work article 16 at a high speed and then comes to an abrupt stop can be absorbed by the swinging of swing lever 32 about fulcrum pin 34. This further minimizes the forces exerted upon arm 14 of robot 10.

The force exerted on work article 16 may be adjusted in various ways within the scope of the present invention. For example, the point of contact of work article 16 along swing lever 32 can be varied. In this manner, the force exerted on work article 16 can be increased by having robot 10 locate work article 16 closer to fulcrum pin 34. On the other hand, the exerted force can be decreased by positioning work article 16 farther from fulcrum pin 34. This can be readily accomplished by simply reprogramming robot 10. In addition, the exerted force can be varied by changing the fluid pressure of actuator 48.

The arrangement illustrated in FIG. 1 provides certain advantages that provide compensation for thermal effects on the various arms and linkages of the robot 10. For example, due to thermal expansion and contraction, the lengths of arms 10*b* and 14 can vary to effectively change the position of the work product 16 relative to the polishing belt 46. However, it will be noted that the general orientation of swing lever 32 is essentially parallel with the robot arm 14 so that variations in the length of arm 14 would have no appreciable effect on the position of the work product 16 relative to the belt 46 in a direction perpendicular to the sanding zone. Variations in the vertical direction, for example variations caused by variations in the length of arm 10*b*, could be compensated for by a simple manual adjustment in the robot linkages to compensate for the change in vertical positioning of the work product 16 relative to the sanding zone due to thermal effects acting on the robot. Of course, appropriate software programming also could be utilized to provide proper compensation for thermal effects, particularly in the vertical direction.

The polishing system furthermore can include a system for avoiding excessive pressure between the polishing belt 46 and a work article 16 that presents small contact areas between the belt and the work article. For example, the position of work article 16 can be altered depending upon the size of the region to be polished. Also, a higher burr height can be compensated for by increasing the rotating speed of the polishing belt 46, perhaps in combination with movement of the work article 16 closer to or farther from fulcrum pin 34.

When the polishing of work article 16 by belt sander A is completed, robot 10 transfers work article 16 to the R-sander B to polish the corners of work article 16 to a specified curvature. Work article 16 is then moved along to long sander C, drill machine D and disk machine E successively and finally to reel sander F.

Figure 2:
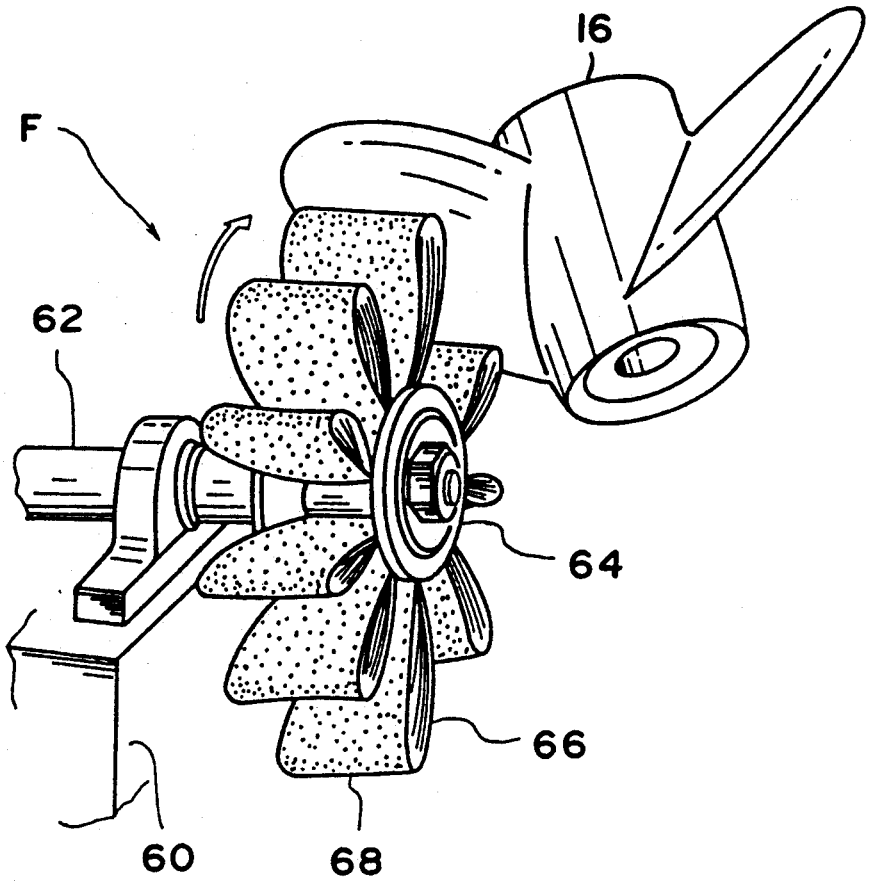
FIG. 2 is a perspective view of a second embodiment of the invention.

Specific reference will now be made to FIG. 2 in defining the manner in which a substantially constant polishing force is exerted on work article 16 by wheel sander F. As shown in FIG. 2, wheel sander F is rotatably mounted upon a supporting stand 60 such that a rotating drive shaft 62 of wheel sander F is substantially horizontally supported. A polishing wheel 64 is fixedly secured to one end of drive shaft 62. Drive shaft 62 is rotated by an electric motor (not shown) which, in the preferred embodiment, runs at a constant speed. Fastened at predetermined intervals about polishing wheel 64 are a plurality of radially extending flexible members 66. In the embodiment shown, each member 66 is wrapped with emery paper 68 that loops around the plate member in the form of an endless belt. Emery paper 68 belt is movable circumferentially around its respective flexible member to accommodate wear as will be more fully discussed below. The specific internal structure of polishing wheel 64 is disclosed in detail in Japanese unexamined patent publication HEI 2-167674, and U.S. patent application Ser. No. 07/650,996 filed Feb. 4, 1991, now U.S. Pat. No. 5,119,601, which are all incorporated herein by reference, and therefore its detailed description will not be presented here.

According to this arrangement, when robot 10 brings work article 16 into contact with emery paper 68, the emery paper 68 becomes inclined together with flexible members 66 and polishes the surface of work article 16. Each emery paper belt 68 is moved in the circumferential direction along its own length a little by the contact resistance. In a manner analogous to the embodiment described above, the emery paper 68 in this embodiment also makes contact with work article 16 with a substantially constant contacting pressure due to the flexibility of members 66. This contact pressure is a function of the restoring and centrifugal forces associate with the members 66.

In this embodiment, the polishing depth can be adjusted by changing the position of work article 16 relative to drive shaft 62, changing the rotating speed of wheel 64 or by changing the moving speed of work article 16.

From the above description of preferred embodiments of the invention, it can readily be seen that the polishing head in each embodiment is permitted to retract so that the force exerted on the work article may be kept generally constant. Wear of the polishing tool is accommodated for without adding any special function to the operation of the robot. Therefore, no special sensors or devices are required to be provided separately, the structure simplified, and the work time of the polishing devices are increased. Even if the work article is pushed against the polishing tool with an excessive force, this force will not be felt by the robot arm because the polishing tool retracts. This enables a simplified robot motor protecting system to be utilized.

Although the specific preferred embodiment shows swing lever 32 mounted intermediate its ends for rotation about pivot 34, it is to be understood that the pivot 34 could be located at one end of the swing lever 32 and the actuator 48 could be located anywhere along the length of the swing lever 32 spaced from the pivot 34. With such an arrangement, the work article 16 could engage the swing lever 32 anywhere along its length, since the motion of the lever 32 would be pivotal about fulcrum pin 34 which would be located at one end of the swing lever 32. In any event, the leverage of the actuator relative to the work article would vary depending on the position of the latter relative to the pivot 34.

Although the present invention has been discussed as applied to a belt sander A and a wheel sander F above, it should be readily understood that this invention can be applied to various polishing tools and systems other than those described. In addition, the present invention is equally applicable to polishing machines wherein the work is transferred to the polishing tools in a horizontal direction or at an angle. In general, various changes and/or modifications can be made to the present invention without departing from the spirit or scope of the invention as defined by the following claims.

We claim:

1. An apparatus for polishing a work article comprising:

at least one polishing head;

means for positioning a work article into engagement with said at least one polishing head; and means for movably supporting said polishing head such that the force exerted on a work article in engagement with a preselected portion of said polishing head is maintained substantially constant during the polishing operation, wherein said supporting means includes a support stand, a swing arm pivotally mounted to said support stand for pivotal movement about a fixed axis, and means for forcibly pivoting said swing arm relative to said support stand about said axis, said at least one polishing head being associated with said swing arm so that the polishing head is movable towards and away from such work article upon pivoting of said swing arm and wherein said means for positioning a work article includes means for adjusting the distance of a predetermined section of said work article towards and away from said fixed axis along said swing arm while maintaining contact between substantially the entire predetermined section of said work article and said at least one polishing head in order to alter the polishing force exerted on the work article.

2. An apparatus for polishing a work article as claimed in claim 1, wherein said means for positioning a work article comprises an industrial robot.

3. An apparatus for polishing a work article as claimed in claim 1, wherein said means for pivoting the swing arm comprises an actuator which is secured between said swing arm and said support stand, said actuator being extendible and retractable to cause pivoting of said swing arm toward and away from a work article to be polished.

4. An apparatus for polishing a work article as claimed in claim 3, wherein said actuator is adapted to bias said polishing head towards a work article engaging and polishing position.

5. An apparatus for polishing a work article as claimed in claim 4, wherein said actuator comprises a fluid actuator, and means for supplying a constant fluid pressure to said actuator to maintain a constant bias force on said polishing head.

6. An apparatus for polishing a work article as claimed in claim 3, wherein said swing arm is pivotally mounted to said support stand by a fulcrum pivot intermediate the ends of said swing arm, said actuator is mounted between said support stand and said swing arm on one side of the pivot, and said polishing head is adapted to engage a work article on the other side of the pivot.

7. An apparatus for polishing a work article as claimed in claim 1, wherein said polishing apparatus comprises a sander.

8. An apparatus for polishing a work article as claimed in claim 7, wherein said at least one polishing head comprises an endless abrasive belt.

9. An apparatus for polishing a work article comprising:

at least one polishing head;

means for positioning a work article into engagement with said at least one polishing head; and means for movably supporting said polishing head such that the force exerted on a work article in engagement with a preselected portion of said polishing head is maintained substantially constant during the polishing operation, wherein said polishing head comprises a belt sander including a sending zone extending in a substantially horizontal sanding plane; said means for supporting said polishing head includes means for moving the location of the sanding plane towards and away from a work article to be polished and inclining said sanding plane relative to a fixed fulcrum axis; said means for positioning a work article includes a support arm located in a plane that is parallel to said sanding plane and means for moving said support arm and a supported work article towards and away from said sanding plane from above and in a direction substantially perpendicular to said sanding plane while permitting the distance between the engaging position of the work article in the sanding zone and said fulcrum axis to be selectively adjusted in order to alter the polishing force exerted on the work article.

* * * * *